US007366059B2

(12) United States Patent
Seyr

(10) Patent No.: US 7,366,059 B2
(45) Date of Patent: Apr. 29, 2008

(54) DISPLAY DEVICE FOR A WRISTWATCH

(75) Inventor: Ernst Seyr, Grenchen (CH)

(73) Assignee: Eterna AG Uhrenfabrik, Grenchen (CH)

( * ) Notice: Subject to any disclaimer, the term of this patent is extended or adjusted under 35 U.S.C. 154(b) by 193 days.

(21) Appl. No.: 10/494,855

(22) PCT Filed: Nov. 4, 2002

(86) PCT No.: PCT/CH02/00592

§ 371 (c)(1),
(2), (4) Date: May 6, 2004

(87) PCT Pub. No.: WO03/042764

PCT Pub. Date: May 22, 2003

(65) Prior Publication Data

US 2005/0018545 A1 Jan. 27, 2005

(30) Foreign Application Priority Data

Nov. 12, 2001 (CH) ..... 2073/01

(51) Int. Cl.
*G04B 19/00* (2006.01)
*G04B 19/24* (2006.01)
*G04B 19/32* (2006.01)

(52) U.S. Cl. ..... 368/226; 368/28; 368/79

(58) Field of Classification Search ..... 368/28, 368/37, 223, 226, 227, 79, 82
See application file for complete search history.

(56) References Cited

U.S. PATENT DOCUMENTS 2,502,985 A * 4/1950 Paulson ..... 368/79
3,156,990 A * 11/1964 Dock ..... 40/573
3,270,201 A * 8/1966 Hardesty ..... 250/458.1
3,729,922 A * 5/1973 Wein ..... 368/35
5,805,533 A * 9/1998 Daigle et al. ..... 368/226
5,980,060 A * 11/1999 Chien ..... 362/103

* cited by examiner

*Primary Examiner*—P. Austin Bradley
*Assistant Examiner*—Jeanne-Marguerite Goodwin
(74) *Attorney, Agent, or Firm*—The Webb Law Firm

(57) ABSTRACT

The invention relates to a display device for a wristwatch comprising a luminescent surface for illuminating the background of a display element consisting of one or more alphanumeric characters. The display device comprises a window in an opaque watch face in which these characters can be displayed. The luminescent surface covers at least one partial area of a supporting surface situated behind said window. The alphanumeric characters of the display element have an opaque material and are located between the watch face and the luminescent surface.

11 Claims, 4 Drawing Sheets

DISPLAY DEVICE FOR A WRISTWATCH

BACKGROUND OF THE INVENTION

1. Field of the Invention

The invention relates to a display device for a wristwatch having a luminescent surface for the background illumination of a display element.

2. Description of the Related Art

It is known from the prior art for digital displays for dates, days of the week and/or chronometer functions to be provided with numbers, in which case an analog movement mechanism simultaneously displays hours, minutes and seconds using hands.

Such timepieces have the advantage that they can be configured purely mechanically and thus do not require any energy source such as a battery and/or a solar cell in order to function. The problem with these analog timepieces, then, is to render the display visible in the dark. For this purpose, it is possible to provide a battery or rechargeable storage battery, by means of which a luminous unit is supplied with energy. U.S. Pat. No. 6,208,591 utilizes a luminescent layer which is arranged in and beneath the then transparent face. This luminescent layer illuminates the hands of the timepiece from behind. However, it is thus not possible to render additional digital information of the timepiece readable in the dark.

It was also known to apply luminescent materials to the hands in order for the latter to be luminous in the dark. The application of these materials to numbers which indicate the digital time units, however, is associated with two significant problems. On the one hand, the application of these materials results in these digital time displays becoming considerably thicker. Furthermore, such displays only appear in a window during the corresponding time unit and are otherwise covered by the face, with the result that they are not recharged to a sufficient extent.

There is no question of using radioactive products for sales of timepieces in the civilian sector.

Wristwatches, finally, are often provided exclusively with a digital display of time units. These watches are usually with an LCD display. Such watches require a power source.

SUMMARY OF THE INVENTION

Taking this prior art as the departure point, the object of the invention is to configure a display device of the type mentioned in the introduction such that the digital time display is also visible in the dark.

Since it is exclusively the region behind the window in the face which is coated with the luminescent material, it can be ensured that this region is constantly recharged when the watch is worn, provided the watch is not covered by clothing. The numbers which appear in the window either are introduced in a transparent disk or consist essentially of a punched-out material, the parts of which are connected to one another merely via thin connecting crosspieces. This has the advantage that it is only in the region of this window that account has to be taken of the considerable thickness of the luminescent material, but the number disks, which bear the digital time-display units, may be of very thin configuration, in the customary manner.

Further advantageous embodiments are characterized in the subclaims.

BRIEF DESCRIPTION OF THE DRAWINGS

The invention will now be described by way of example using exemplary embodiments and with reference to the attached drawings, in which.

DESCRIPTION OF THE PREFERRED EMBODIMENTS

Figure 1:
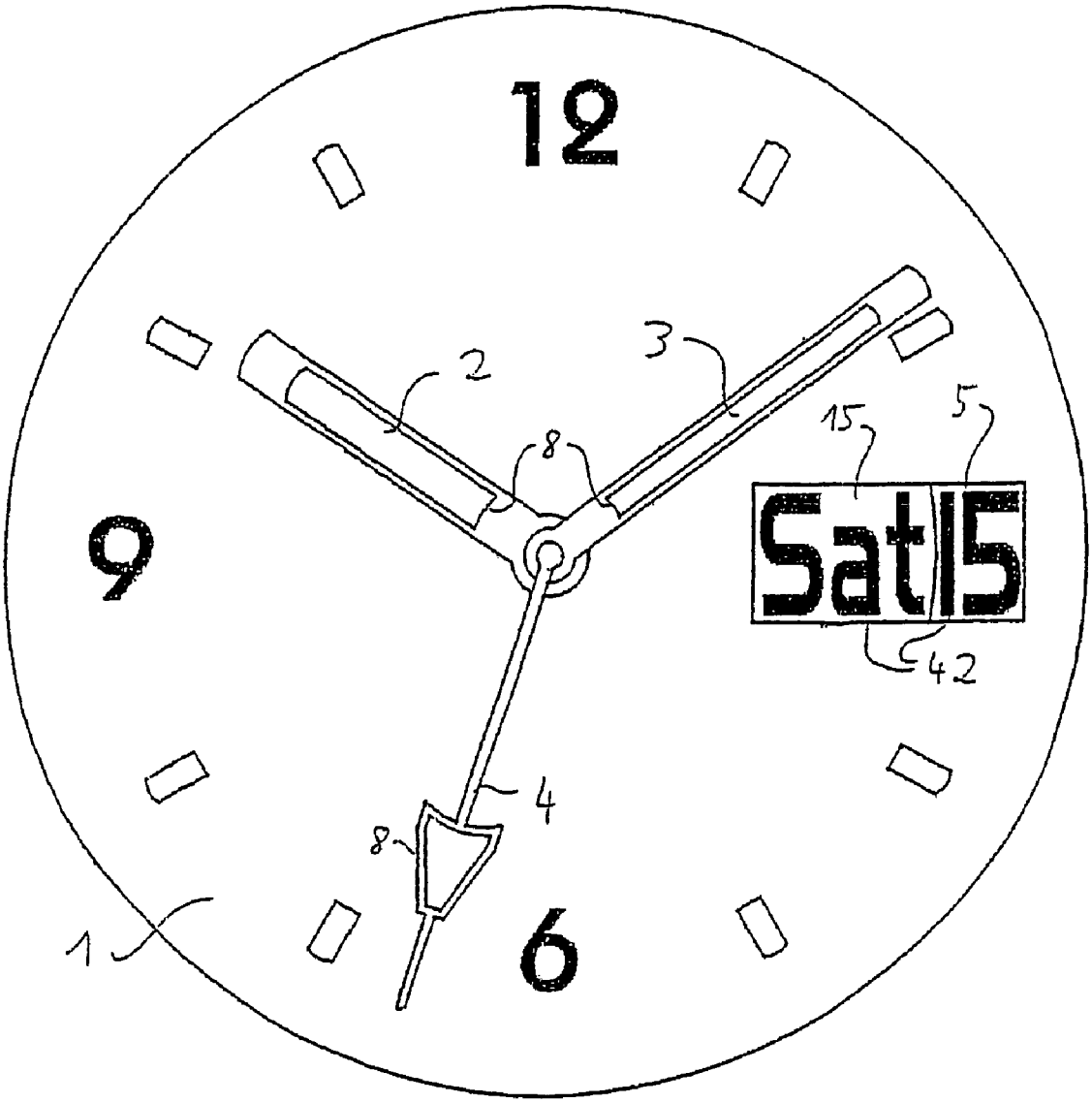
FIG. 1 shows a schematic plan view of a wristwatch with a digital date function according to a first exemplary embodiment of the invention.

FIG. 1 shows a plan view of a wristwatch with a face 1, an hour hand 2, a minute hand 3 and a second hand 4. Also provided are two windows 5 and 15, in which it is possible to see the current date, in this case the number 15 for the fifteenth day of the month, and, in this case, the letters "Sat" for the current day of the week (Sat for Saturday). The display elements are designated in general terms by 42. It is, of course, also possible to provide just one window 5. The configuration according to the invention of the region of the window or windows 5, 15 is illustrated in the detail-form drawing of FIG. 3.

Figure 2:
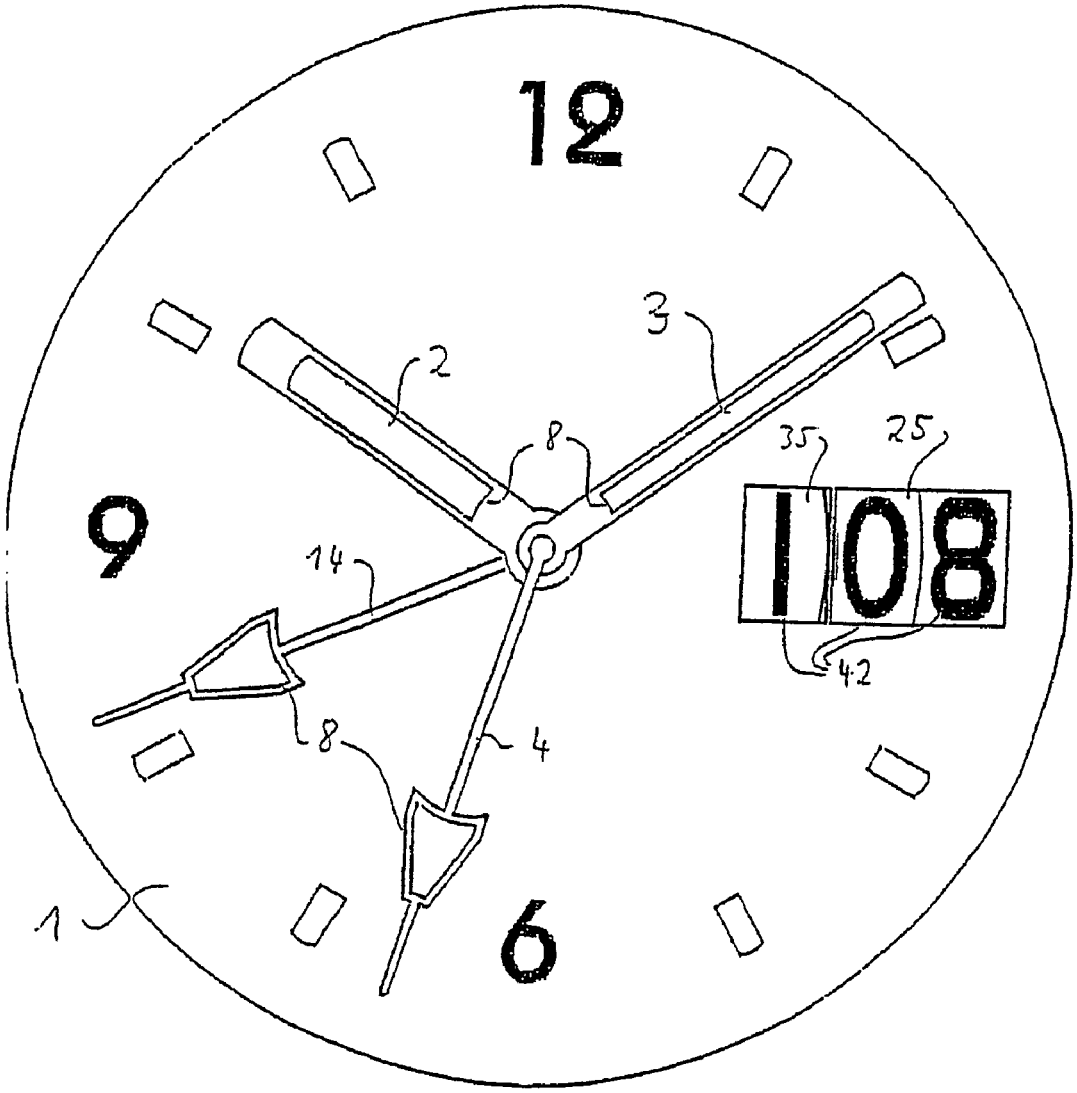
FIG. 2 shows a schematic plan view of a wristwatch with a digital chronometer function according to a second exemplary embodiment of the invention.

FIG. 2 shows a different wristwatch, this time configured as a chronometer. The same features are indicated by the same designations in all the figures. This watch according to FIG. 2 likewise has the hour hand 2, the minute hand 3 and the second hand 4. A further coaxial second hand 14 is provided for the chronometer function. The stopped minutes can be seen in the window 25 (in this case eight minutes) and the stopped and elapsed time in hours (in this case one hour) can be seen in the adjacent window 35.

The hands 2, 3 and 4 and also 14 in the exemplary embodiments according to FIGS. 1 and 2 are each provided with conventional luminescent coatings 8, with the result that the hands can also be read in the dark. The windows 5, 15 and 25, 35 are configured in accordance with the invention in order that the alphanumeric characters there can also be read in the dark, this being described in more detail by way of two exemplary embodiments in conjunction with FIGS. 3 and 4.

Figure 3:
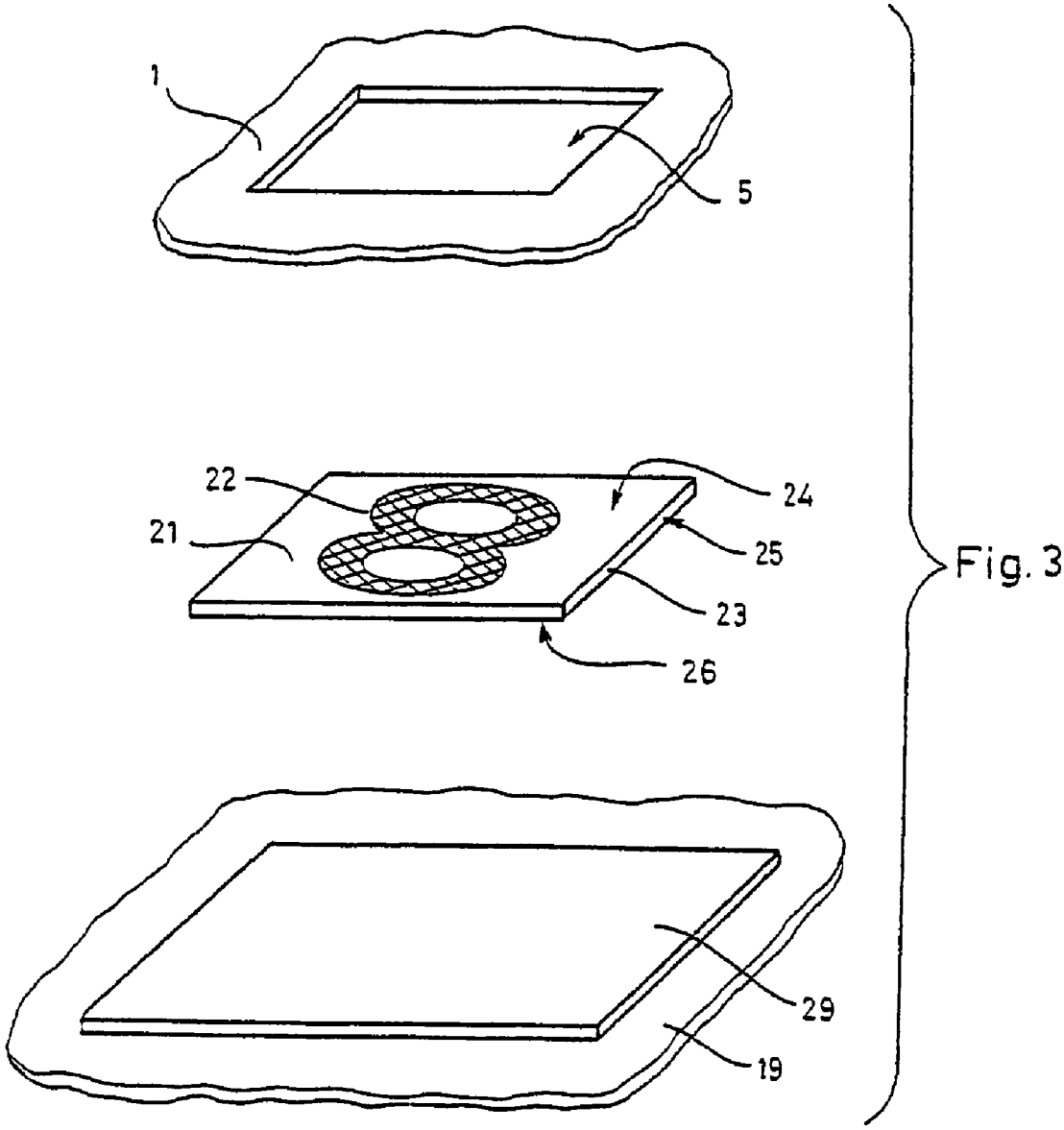
FIG. 3 shows an exploded view with a schematic illustration of the region around the window of the first exemplary embodiment according to FIG. 1.

FIG. 3 shows a schematic exploded view of a first exemplary embodiment for displaying the number "8" in the window 5. The configuration for the windows 15, 25 and 35 may be identical in each case. The window 5 is an opening, in this case of square form, in the face 1. At least one disk 21, preferably rotating about the hand axis, is arranged beneath the face 1. An essentially square section of the disk is illustrated here, this section having light acting on it through the surface area of the window 5. It is possible to provide one disk 21 per display unit, i.e. two disks for the day of the week and date, and three disks for hours, 10s of minutes and minutes for a chronometer function.

The disk 21 which is illustrated here by way of example comprises a region 23 of transparent material which has arranged in its interior 25 or on its surface at the top 24 or bottom 26, preferably at the top 24, an opaque display element, in this case the number "8", which is designated 22.

Arranged beneath this rotating disk 21, opposite the window 5, is a disk 19 which is fixed in relation to the housing of the watch and, in its central region, is provided with luminescent material, designated 29 here. The surface coated by the luminescent material 29 is advantageously somewhat larger than the opening of the window 5, with the result that even slanting incident light through the window 5, this light passing through the disk 21, illuminates border regions of the luminescent material and thus also charges the same.

The disk 21 is advantageously highly transparent and has a slightly diffusing action on its underside 26, with the result that, irrespective of the region covered by the display element 22, those sub-regions of the surface 29 which are located directly beneath the display element 22 also receive light. It is thus the case with each type of display, i.e. with each date and/or each day of the week and/or the chronometer numbers, that most of the surface 29 in each case is illuminated, with the result that, when it is light, the (dark) display element 22 can be read against the light background and, in the dark, it is visible as a negative in relation to the light-emitting element 29.

Figure 4:
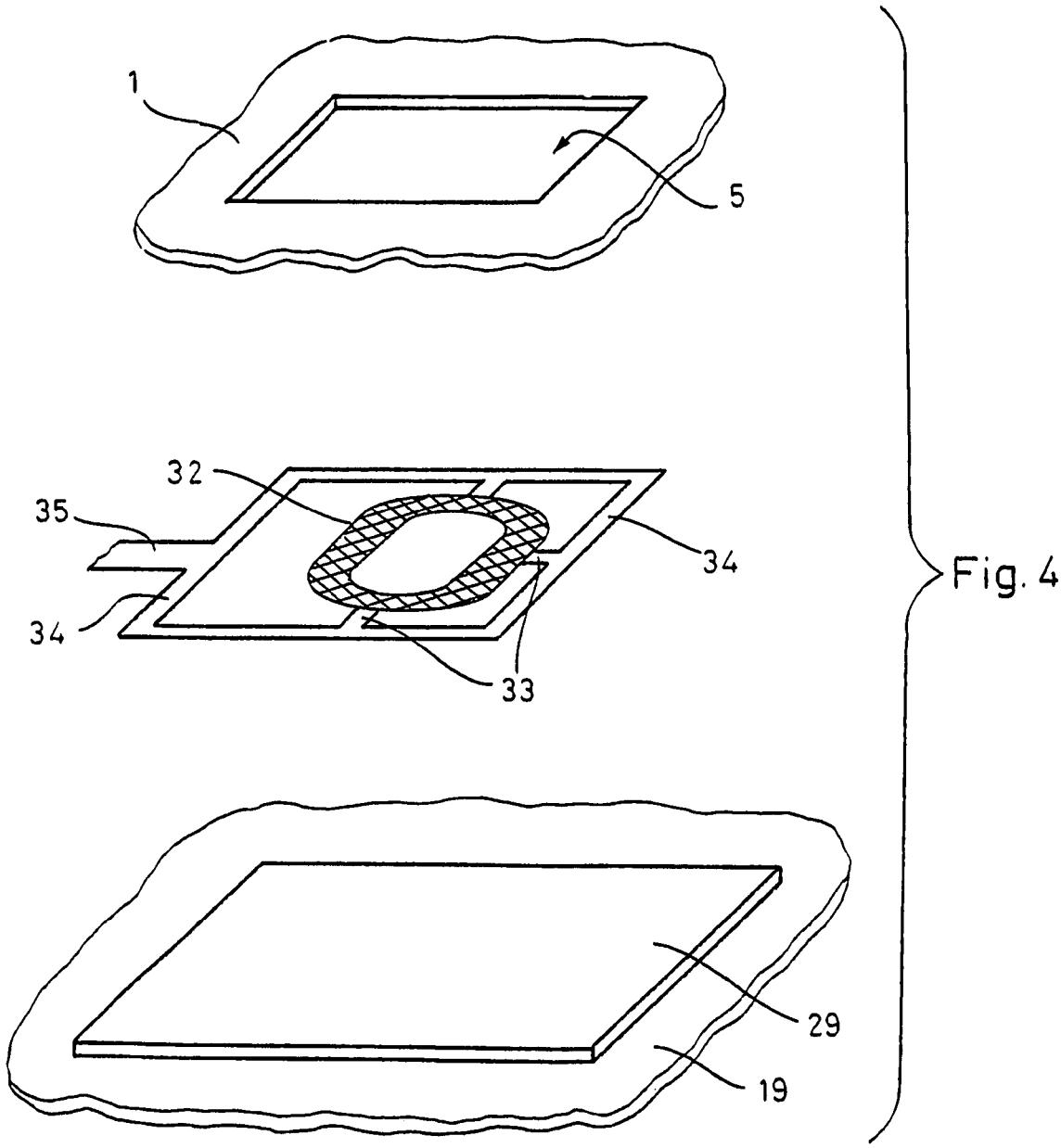
FIG. 4 shows an exploded view with a schematic illustration of the region around the window of the second exemplary embodiment according to FIG. 2.

FIG. 4 shows another embodiment of the invention, the window 5 in the face 9 and the luminescent surface 29 in the region 19 being the same. The difference in relation to FIG. 3 relates to the type of display elements, in this case designated 32. The display element 32, in this case-the number "0", is connected via small crosspieces 33 to a carrier structure 34 which, as it were, replaces the disk 21, which for each display of an alphanumeric character, in this case of a number, is located outside the window 5. The carrier structure may be connected to the inner region of the carrier via a radial connecting crosspiece 35. All the crosspieces 33, 34 and the character 32 are of very thin configuration and, for reasons of simplicity, are illustrated in two-dimensional form without any thickness.

It is thus possible for the light passing in through the window 5 to act on the luminescent surface 29 without obstruction, with the exception of the region covered by the display element 32. All the crosspieces 33 and/or the carrier structure 34 may be of transparent configuration and only the display element 32 is opaque, or is made of the same transparent material as the crosspieces 33 but coated with an opaque material.

Both the cases mentioned in FIGS. 3 and 4 have the advantage that the wristwatch provided with this system remains readable in the dark for a long period of time even after the luminescent materials on the surface 29 have been recharged for only a short period, this being the case both for the traditional hour, minute and second display elements and for the additional chronometer function and/or date/day of the week function.

The invention claimed is:

1. A display device for a wristwatch comprising:

an opaque face;

a window within said opaque face;

a carrier surface which is fixedly arranged behind said window;

a photo-luminescent surface covering at least a sub-region of said carrier surface; and a moveable display element comprising at least one alphanumeric character and a supporting structure, wherein:

the at least one alphanumeric character includes an opaque material and is connected via crosspieces to the supporting structure of the display element; and the alphanumeric character is arranged for movement parallel between the opaque face and said photo-luminescent surface providing for the background illumination of the display element.

2. The display device as claimed in claim 1, wherein the at least one alphanumeric character and the crosspieces consist of a transparent material, and wherein the at least one alphanumeric character is covered with an opaque material on one of its top side and its underside.

3. The display device as claimed in claim 1, wherein the luminescent surface is larger than the associated window.

4. A display device for a wristwatch comprising:

an opaque face;

a window within said opaque face;

a carrier surface which is fixedly arranged behind said window;

a photo-luminescent surface covering at least a sub-region of said carrier surface; and a moveable display element comprising a moveable transparent disk and at least one alphanumeric character, wherein:

the alphanumeric character includes an opaque material and is arranged within the moveable transparent disk; and the alphanumeric character is arranged for movement parallel between the opaque face and said photo-luminescent surface providing for the background illumination of the display element.

5. The display device as claimed in claim 4, wherein the transparent disk is configured on the underside so that light passing through it is diffused.

6. The display device as claimed in claim 5, wherein the luminescent surface is larger than the associated window.

7. The display device as claimed in claim 4, wherein the luminescent surface is larger than the associated window.

8. A display device for a wristwatch comprising:

an opaque face;

a window within said opaque face;

a carrier surface which is fixedly arranged behind said window;

a photo-luminescent surface covering at least a sub-region of said carrier surface; and a moveable display element comprising a moveable transparent disk and at least one alphanumeric character, wherein:

the alphanumeric character includes an opaque material and is fastened on the moveable transparent disk; and the alphanumeric character is arranged for movement parallel between the opaque face and said photo-luminescent surface providing for the background illumination of the display element.

9. The display device as claimed in claim 8, wherein the transparent disk is configured on the underside so that light passing through it is diffused.

10. The display device as claimed in claim 9, wherein the luminescent surface is larger than the associated window.

11. The display device as claimed in claim 8, wherein the luminescent surface is larger than the associated window.

* * * * *